US010920446B2

(12) United States Patent
Jin et al.

(10) Patent No.: US 10,920,446 B2
(45) Date of Patent: Feb. 16, 2021

(54) REINFORCING CONNECTOR FOR SHADE SCREEN

(71) Applicants: Yan Jin, Pomona, CA (US); Qing Feng Lyu, Hangzhou (CN)

(72) Inventors: Yan Jin, Pomona, CA (US); Qing Feng Lyu, Hangzhou (CN)

( * ) Notice: Subject to any disclaimer, the term of this patent is extended or adjusted under 35 U.S.C. 154(b) by 145 days.

(21) Appl. No.: 16/022,314

(22) Filed: Jun. 28, 2018

(65) Prior Publication Data

US 2020/0002969 A1 Jan. 2, 2020

(51) Int. Cl.
*E04H 15/64* (2006.01)
*E04H 15/54* (2006.01)
*E04H 15/32* (2006.01)

(52) U.S. Cl.
CPC ..... *E04H 15/54* (2013.01); *E04H 15/322* (2013.01); *E04H 15/64* (2013.01)

(58) Field of Classification Search
CPC ..... E04H 15/15; E04H 15/322; E04H 15/54; E04H 15/64; E04H 15/326; E04F 10/02; Y10T 24/476; Y10T 24/44017; B63H 2009/088
USPC ..... 160/328, 354, 327; 135/115, 119, 120.3, 135/120.4
See application file for complete search history.

(56) References Cited

U.S. PATENT DOCUMENTS 96,270 A * 10/1869 Sawyer ..... B63H 9/08 114/114
1,871,101 A * 8/1932 Waltz ..... B63B 19/24 135/119
2,473,217 A * 6/1949 Peoples ..... E04F 10/02 403/205
2,604,897 A * 7/1952 Cottor ..... B60J 7/104 135/119
3,162,920 A * 12/1964 Durham ..... E04H 15/64 24/265 R
4,175,305 A * 11/1979 Gillis ..... E04H 15/32 135/119
4,290,243 A * 9/1981 Mellin ..... E04H 15/64 135/120.4
4,686,748 A * 8/1987 Kaivanto ..... E04H 15/64 24/460
D296,886 S * 7/1988 Young, Jr. ..... D12/162
4,777,071 A * 10/1988 Liu ..... A44B 13/0082 428/120
4,906,503 A * 3/1990 De La Cruz ..... G09F 7/18 116/173

(Continued)

*Primary Examiner* — Kyle J. Walraed-Sullivan
(74) *Attorney, Agent, or Firm* — Tsz Lung Yeung

(57) ABSTRACT

A shade screen includes a screen fabric, a tightening wire and a reinforcing connector. The reinforcing connector includes a head connecting member and a reinforcing body. The head connecting member has a through connecting slot and a peripheral securing slot. The reinforcing body has a receiving cavity, a first reinforcing groove and a second reinforcing groove formed on two sides of the receiving cavity respectively. The first reinforcing groove and the second reinforcing groove are aligned with two ends of the peripheral securing slot in such a manner that a corner portion of the screen fabric is securely attached in the receiving cavity, while the tightening portion of the tightening wire is arranged to pass through the first reinforcing groove and the second reinforcing groove and fittedly receive in the peripheral securing slot.

9 Claims, 8 Drawing Sheets

(56) References Cited

U.S. PATENT DOCUMENTS 5,033,170 A * 7/1991 Ewert ..... A41F 1/00 24/459
5,046,222 A * 9/1991 Byers ..... D06F 55/00 24/343
5,117,537 A * 6/1992 Hunter ..... A47C 21/022 24/455
5,275,578 A * 1/1994 Adams ..... A63B 5/11 24/713.6
5,291,640 A * 3/1994 Rise ..... A44B 99/00 24/464
5,315,736 A * 5/1994 Nilsson ..... B60J 7/104 135/119
5,415,915 A * 5/1995 Oh ..... E04H 15/64 428/99
5,424,107 A * 6/1995 Lee ..... B68F 1/00 428/137
5,512,347 A * 4/1996 Chu ..... A44B 13/0082 135/119
5,557,830 A * 9/1996 Davis ..... A44B 99/00 24/113 MP
5,560,384 A * 10/1996 Oh ..... E04H 15/64 135/115
5,622,197 A * 4/1997 Valaire ..... E04H 15/003 135/90
5,692,272 A * 12/1997 Woods ..... A44B 99/00 24/115 M
5,922,432 A * 7/1999 Kalal ..... E04H 15/64 428/131
D415,677 S * 10/1999 Cheung ..... D8/403
6,124,017 A * 9/2000 Sokol, Jr. ..... B32B 3/08 428/137
6,199,247 B1 * 3/2001 Tsai ..... A47K 10/14 24/343
7,543,541 B2 * 6/2009 Mason ..... B63H 9/067 114/108
7,837,164 B1 * 11/2010 Getgood ..... E04H 15/64 135/120.3
8,028,381 B2 * 10/2011 Murray ..... A47H 23/01 160/395
8,251,121 B1 * 8/2012 Casey ..... E04F 10/02 160/327
9,174,518 B2 * 11/2015 Wilson ..... B60J 7/104
9,237,821 B2 * 1/2016 Geiger ..... E06B 9/50
9,267,517 B2 * 2/2016 Wilson ..... B60J 7/104
D753,983 S * 4/2016 Toye ..... D8/349
10,301,840 B1 * 5/2019 Jin ..... F16H 31/001
D865,488 S * 11/2019 Jin ..... D8/354
10,655,357 B1 * 5/2020 Graham ..... E04H 15/56
2004/0211453 A1 * 10/2004 Guido ..... E04H 15/64 135/120.4
2005/0178418 A1 * 8/2005 Holub ..... E04H 15/425 135/119
2008/0000056 A1 * 1/2008 Murray ..... A47H 23/01 24/460
2013/0017055 A1 * 1/2013 Vieira ..... B25G 1/02 414/800
2015/0218847 A1 * 8/2015 Toye ..... E04H 15/64 428/101
2017/0284123 A1 * 10/2017 Pena ..... E04F 10/02
2017/0363131 A1 * 12/2017 Pena ..... E04H 15/322
2018/0092440 A1 * 4/2018 Tortorella, Jr. .... A44B 13/0082
2019/0376311 A1 * 12/2019 Butler ..... E04H 15/44
2020/0002969 A1 * 1/2020 Jin ..... E04H 15/322

* cited by examiner

REINFORCING CONNECTOR FOR SHADE SCREEN

BACKGROUND OF THE PRESENT INVENTION

Field of Invention

The present invention relates to a shade screen, and more particularly to a shade screen comprising a reinforcing connector which is capable of providing enhanced structural support between the shade screen and an external object.

Description of Related Arts

A conventional shade screen usually comprise a screen fabric and a plurality of fasteners provided corner portions of the screen fabric for applying a certain amount of tension to the screen fabric. The screen fabric may then be stretched and extended and to be hung on an external object through the fasteners.

As an example, referring to FIG. 1 of the drawings, a conventional shade screen 1P comprises a screen fabric 10P and a plurality of fasteners 20P provided on corner portions of the screen fabric 10P. The screen fabric 10P comprises a main fabric piece 11P and a reinforcing fabric piece 12P provided at a corner portion of the main fabric piece 11P. The reinforcing fabric piece 12P serve to reinforce and provide secure connection between the main fabric piece 11P and the fastener 20P. The shade screen 1P further comprises a tightening wire 30P extending along a peripheral edge of the main fabric piece and connect to the fasteners 20P.

Each of the fasteners 20P has a connecting loop 21P and a fastening loop 22P wherein the reinforcing fabric piece 12P is connected to the connecting loop 21P while the fastening loop 22P is adapted for connecting to an external object, such as a connecting pin provided on a wall.

There exist several disadvantages in relation to the above-mentioned conventional shade screen. First, the screen fabric 10P is usually subject to a certain amount of tension when in use. When the fasteners 20P are connected to an external object, the tightening wire 20P must be tightened with respect to the screen fabric 10P so that the screen fabric 10P can be adequately stretched for providing proper shading to the people or objects underneath. That means the screen fabric 10P is subject to a considerable amount of tension when in use. When the tension exerted is too large, the connection between the main fabric piece 11P and the reinforcing fabric piece 12P may break.

Second, the tension exerted on the screen fabric 10P is transmitted by the tightening wire 30P, which is usually made by metallic material. As a result, when the tightening wire 30P is tightened, the portion of the fabric screen (such as the edge portion of the main fabric piece 11P) which is in the vicinity or in contact with the tightening wire will be subject to considerable amount of force. Since the screen fabric 10P is made by fabric material, the portion of the fabric screen (such as the edge portion of the main fabric piece 11P) which is in the vicinity or in contact with the tightening wire may break when the shade screen is used for an extended period of time.

The above-mentioned disadvantages substantially shorten the general lifespan of the shade screen. As a result, there is a need to develop a shade screen which may improve upon the above-mentioned conventional shade screen and minimize the possibility of breakage on the part of the screen fabric.

SUMMARY OF THE PRESENT INVENTION

Certain variations of the present invention provide a shade screen comprising a reinforcing connector which is capable of providing enhanced structural support between the shade screen and an external object.

Certain variations of the present invention provide a shade screen comprising a reinforcing connector which is capable of preventing stress concentration on any part of the screen fabric so as to minimize the possibility of breakage.

Certain variations of the present invention provide a shade screen comprising a reinforcing connector which eliminates the need to have the main fabric piece and the reinforcing fabric piece for a screen fabric.

In one aspect of the present invention, it provides a shade screen, comprising:

a screen fabric having a main fabric portion and at least one corner portion;

a tightening wire attached on the screen fabric, the tightening wire having a main portion and a tightening portion extended on the corner portion of the screen fabric; and a reinforcing connector, which comprises:

a head connecting member having a through connecting slot and a peripheral securing slot formed along a peripheral edge portion of the head connecting member; and a reinforcing body having a receiving cavity, a first reinforcing groove and a second reinforcing groove formed on two sides of the receiving cavity respectively, the first reinforcing groove and the second reinforcing groove being aligned with two ends of the peripheral securing slot of the head connecting member, in such a manner that the corner portion of the screen fabric is securely attached in the receiving cavity, while the tightening portion of the tightening wire is arranged to pass through the first reinforcing groove and the second reinforcing groove and fittedly receive in the peripheral securing slot so that the tightening wire is substantially reinforced and supported in the reinforcing connector as to prevent the tightening wire from breaking out of the screen fabric when the screen fabric is subject to external force.

Another aspect of the present invention provides a reinforcing connector for a shade screen having a screen fabric having a corner portion and a tightening wire having a tightening portion, the reinforcing connector comprising:

a head connecting member having a through connecting slot and a peripheral securing slot formed along a peripheral edge portion of the head connecting member; and a reinforcing body having a receiving cavity, a first reinforcing groove and a second reinforcing groove formed on two sides of the receiving cavity respectively, the first reinforcing groove and the second reinforcing groove being aligned with two ends of the peripheral securing slot of the head connecting member, in such a manner that the corner portion of the screen fabric is securely attached in the receiving cavity, while the tightening portion of the tightening wire is arranged to pass through the first reinforcing groove and the second reinforcing groove and fittedly receive in the peripheral securing slot so that the tightening wire is substantially reinforced and supported in the reinforcing connector as to prevent the tightening wire from breaking out of the screen fabric when the screen fabric is subject to external force.

This summary presented above is provided merely to introduce certain concepts and not to identify any key or essential features of the claimed subject matter.

DETAILED DESCRIPTION OF THE PREFERRED EMBODIMENT

Figure 1:
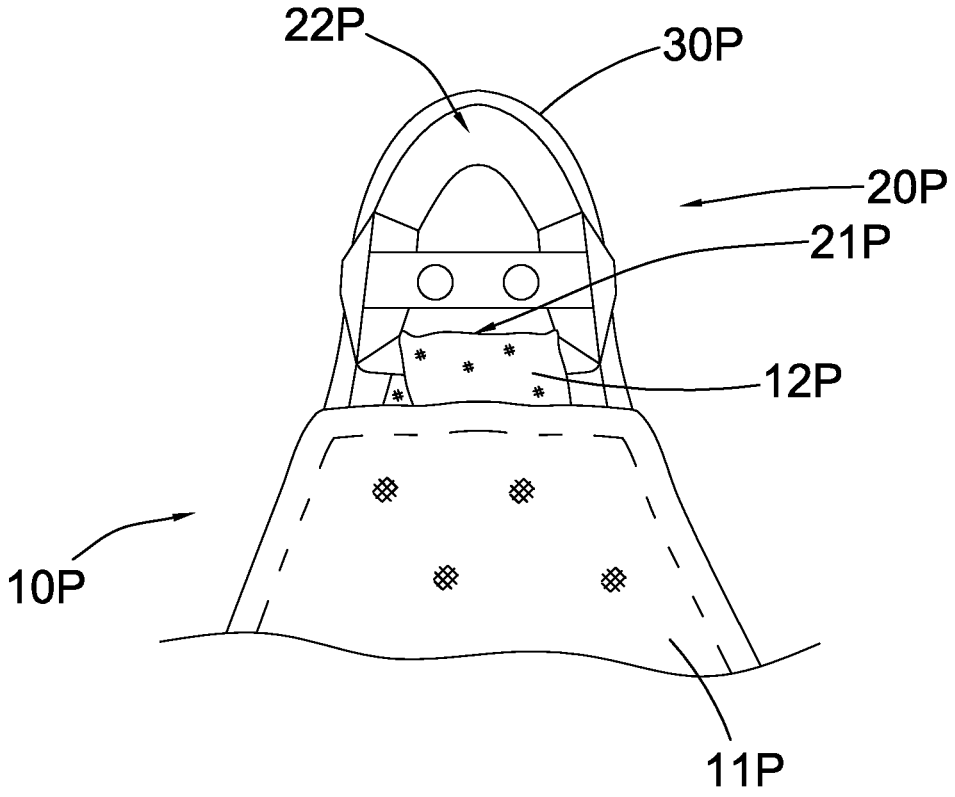
FIG.1 PRIOR ART
FIG. 1 is a conventional connector for a sun shade.

The following detailed description of the preferred embodiment is the preferred mode of carrying out the invention. The description is not to be taken in any limiting sense. It is presented for the purpose of illustrating the general principles of the present invention.

Referring to FIG. 2 to FIG. 8 of the drawings, a shade screen according a preferred embodiment of the present invention is illustrated. Broadly, the shade screen may comprise a screen fabric 10, a tightening wire 20, and a reinforcing connector 30.

The screen fabric 10 may have a main fabric portion 11 and at least one corner portion 12.

The tightening wire 20 may be attached on the screen fabric 10, and may have a main portion 21 and a tightening portion 22 extended on the corner portion 12 of the screen fabric 10.

The reinforcing connector 30 may comprise a head connecting member 31 and a reinforcing body 32. The head connecting member 31 may have a through connecting slot 311 and a peripheral securing slot 312 formed along a peripheral edge portion 313 of the head connecting member 31.

The reinforcing body 32 may have a receiving cavity 321, a first reinforcing groove 322 and a second reinforcing groove 323 formed on two sides of the receiving cavity 321 respectively. The first reinforcing groove 322 and the second reinforcing groove 323 may be aligned with two ends of the peripheral securing slot 312 of the head connecting member 31, in such a manner that the corner portion 12 of the screen fabric 10 may be securely attached in the receiving cavity 321, while the tightening portion 22 of the tightening wire 20 may be arranged to pass through the first reinforcing groove 322 and the second reinforcing groove 323 and fittedly receive in the peripheral securing slot 312 so that the tightening wire 20 may be substantially reinforced and supported in the reinforcing connector 30 as to prevent the tightening wire 20 from breaking out of the screen fabric 10 when the screen fabric 10 is subject to external force.

According to the preferred embodiment of the present invention, the screen fabric 10 may be configured from sufficiently strong material which may be capable of providing shade to the people or object underneath. The screen fabric 10 may be configured to have a wide variety of shapes, such as rectangular, square, or triangular. In this preferred embodiment, the screen fabric 10 may have a rectangular cross-sectional shape and may have four corner portions 12.

The main portion 21 of the tightening wire 20 may be embedded in the main fabric portion 11 of the screen fabric 10. Thus, the screen fabric 10 may further have a plurality of receiving pockets 13 peripherally extended along peripheral edges 111 of the main fabric portion 11 wherein the main portion 21 of the tightening wire 20 may be received in the receiving pockets 13.

In this preferred embodiment, the tightening wire 20 may have a plurality of tightening portions 22 which may be defined as the portions of the tightening wire 20 which does not receive in the receiving pockets 13 and extend along the corner portions 12 of the screen fabric 10 and the reinforcing connectors 30. Thus, the tightening wire 20 may peripherally extended around the screen fabric 10 in such a manner that the main portion 11 may be received in the receiving pockets 13 while the tightening portions 22 may be arranged to expose out of the receiving pockets 13 and engage with or couple to the corresponding reinforcing connectors 30.

The tightening wire 20 may be configured from metallic material which may withstand and exert a considerable amount of tension to the screen fabric 10. At the same time, however, the structural integrity of the entire screen fabric 10 may be reinforced and ensured by the reinforcing connector 30.

The reinforcing connector 30 may be configured from metallic material for allowing enhanced structural integrity. The head connecting member 31 and the reinforcing body 32 may be integrally connected with each other to form an integral structure of the reinforcing connector 30. The head connecting member 31 may have a substantially circular cross section in which the through connecting slot 311 may be formed on the head connecting member 31 for allowing an external object, such as an external connector, to pass through the head connecting member 31. The through connecting slot 311 may also have a substantially circular cross-sectional shape.

The peripheral securing slot 312 may be indently formed along the peripheral edge portion 313 of the head connecting member 31. The peripheral securing slot 312 may be utilized to accommodate the corresponding tightening portion 22 of the tightening wire 20 when the tightening wire 20 is tightened with respect to the screen fabric 10.

Figure 2:
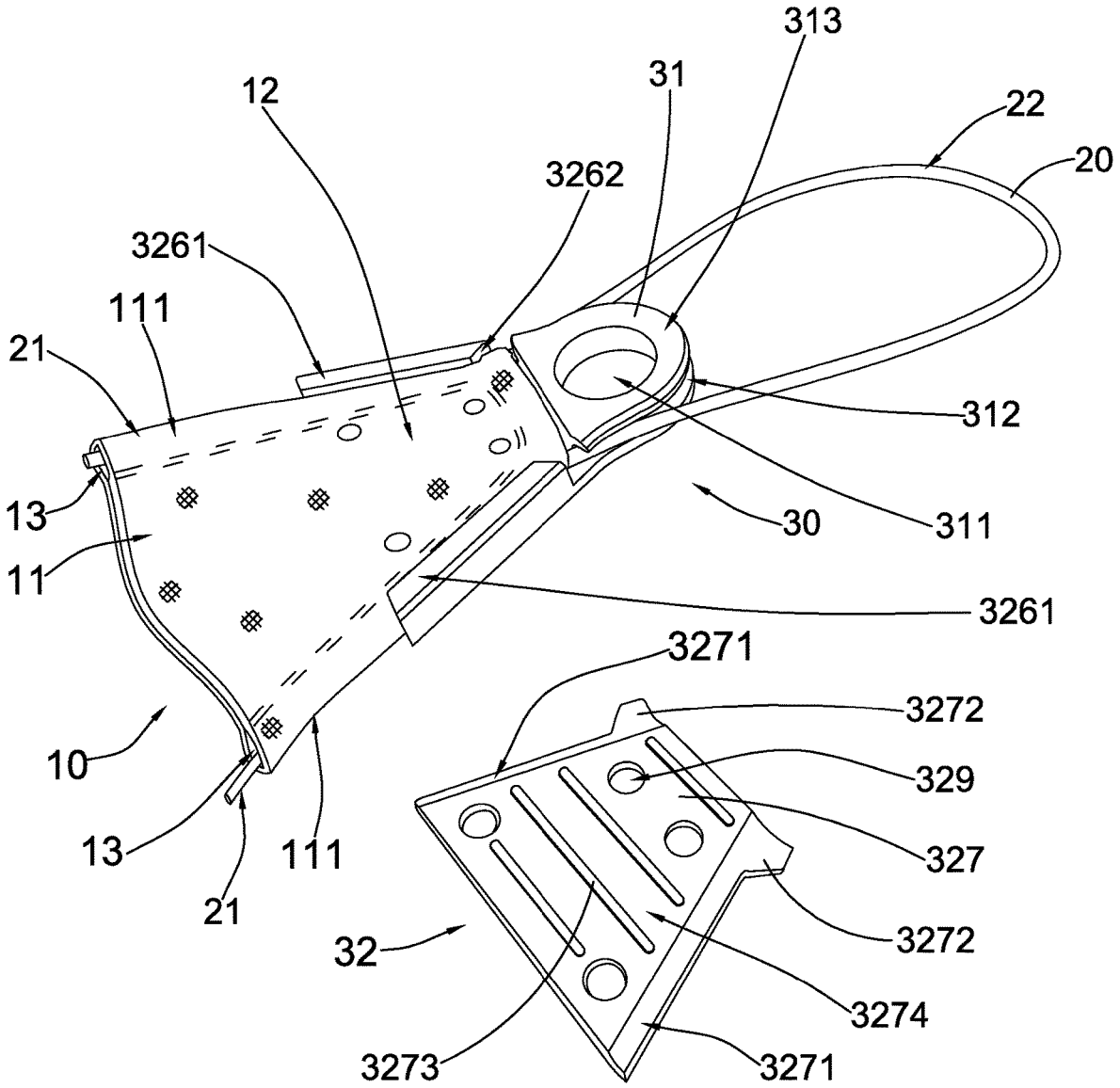
FIG. 2 is a partially perspective view of a shade screen according to a preferred embodiment of the present invention.
Figure 3:
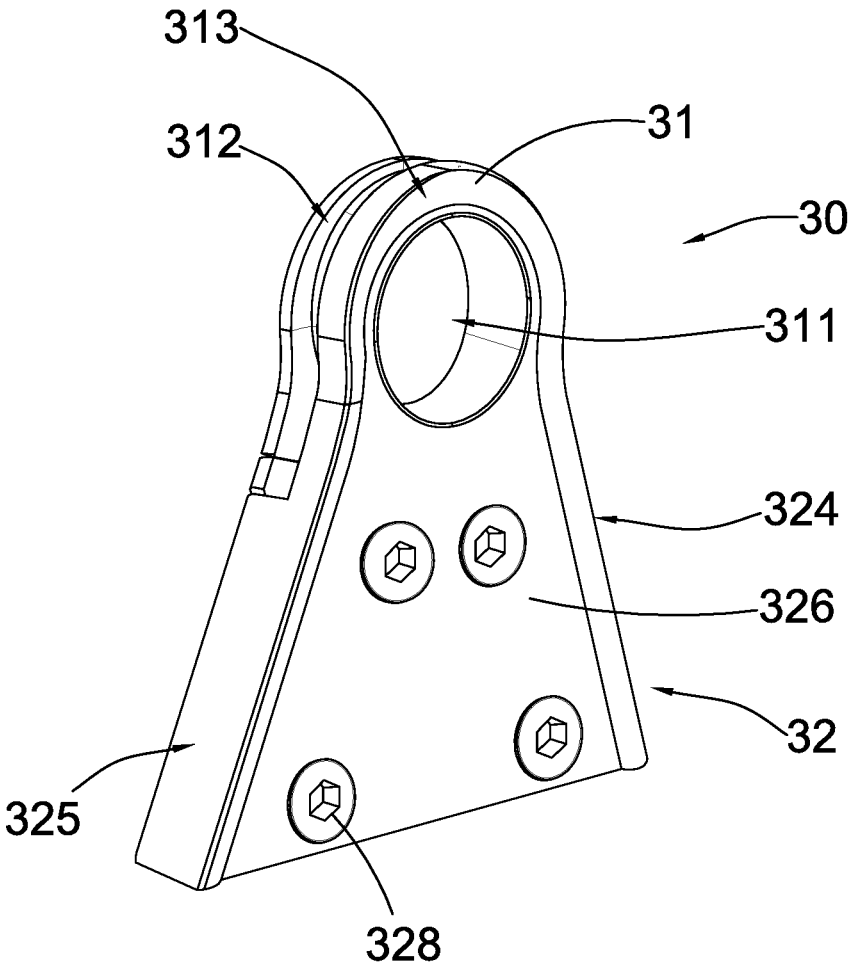
FIG. 3 is a rear perspective view of a reinforcing connector according to the preferred embodiment of the present invention.
Figure 4:
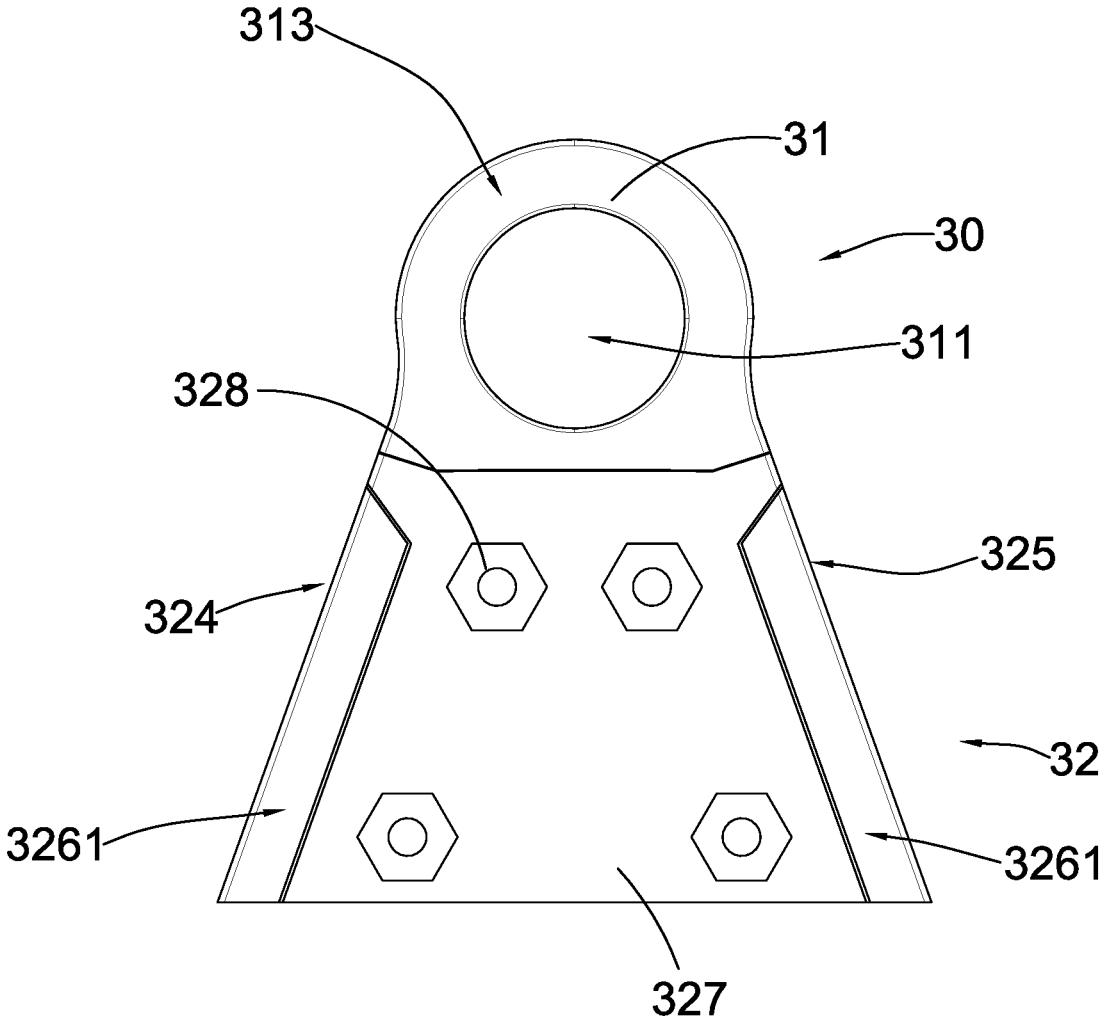
FIG. 4 is a front view of a reinforcing connector according to the preferred embodiment of the present invention.
Figure 5:
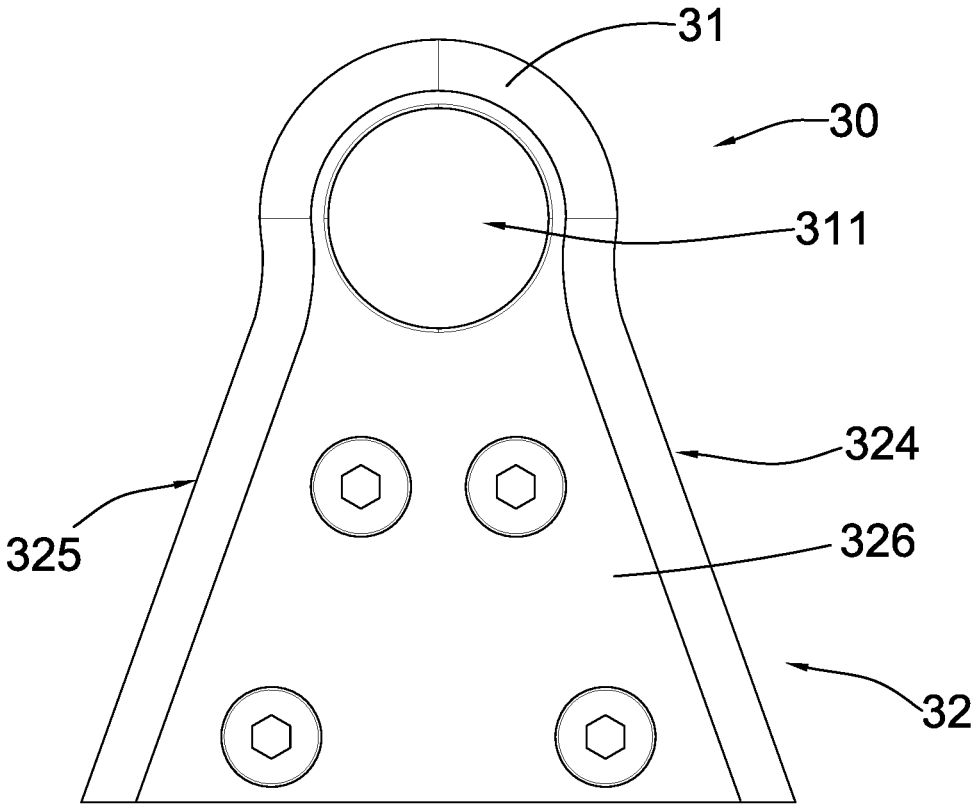
FIG. 5 is a rear view of a reinforcing connector according to the preferred embodiment of the present invention.
Figure 6:
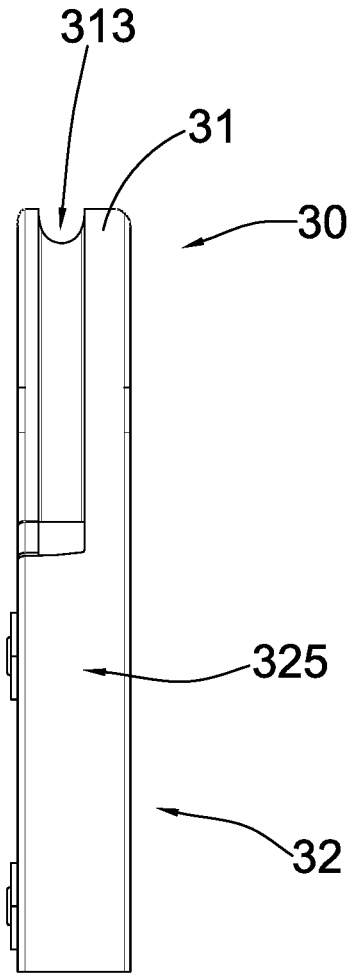
FIG. 6 is a side view of the reinforcing connector according to the preferred embodiment of the present invention.
Figure 7:
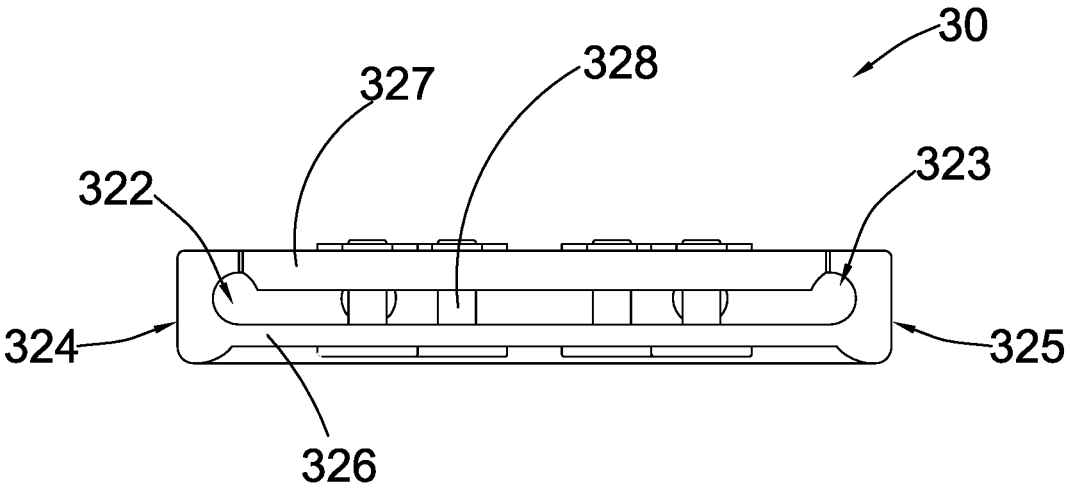
FIG. 7 is a bottom view of the reinforcing connector according to the preferred embodiment of the present invention.
Figure 8:
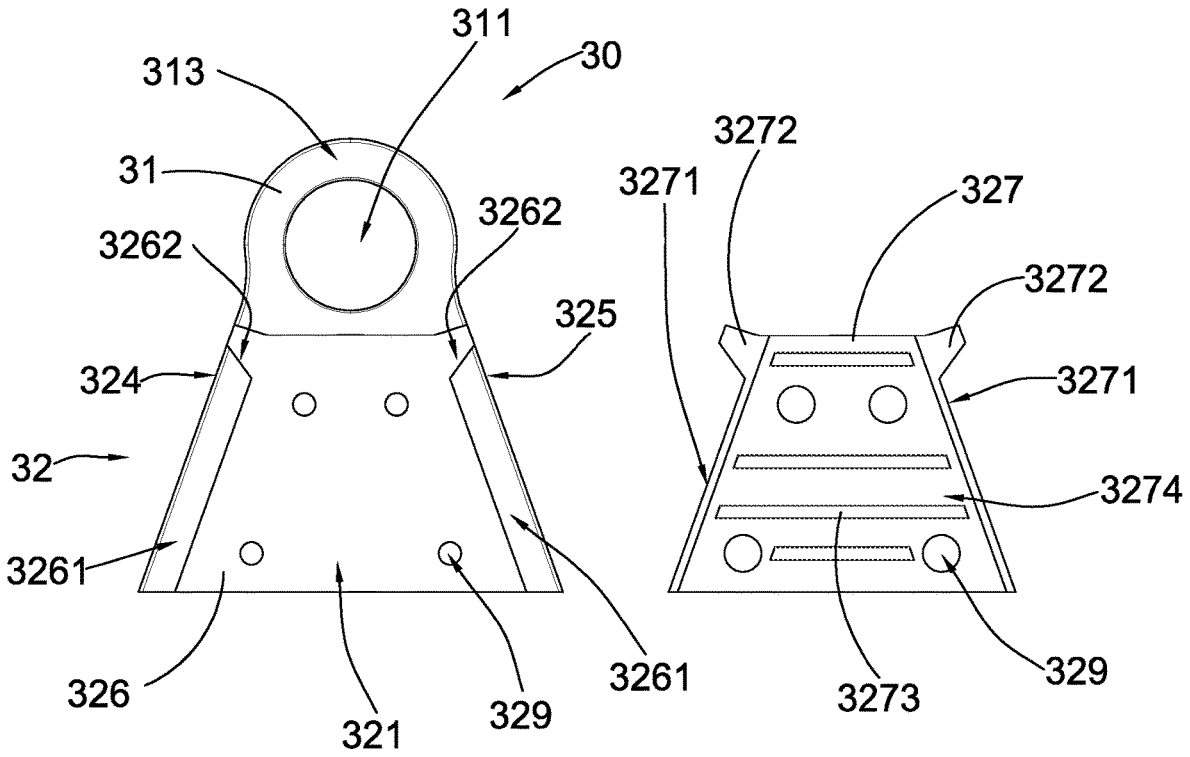
FIG. 8 is a schematic diagram of the reinforcing connector according to the preferred embodiment of the present invention.

On the other hand, the reinforcing body 32 may have a tapered cross section shape and extend from the head connecting member 31. A width of the reinforcing body 32 may gradually increase from the near the head connecting member 31 to near the screen fabric 10, as shown in FIG. 2 and FIG. 8 of the drawings. The first reinforcing groove 322 and the second reinforcing groove 323 may therefore be inclinedly extend along a first sidewall 324 and a second sidewall 325 of the reinforcing body 32 respectively. The first sidewall 324 and the second sidewall 325 may inclinedly extend from two sides of the head connecting member 31 respectively. Hence, the first reinforcing groove 322 and the second reinforcing groove 323 may be indently formed on an inner surface of the first sidewall 324 and the second sidewall 325 respectively.

As shown in FIG. 2 and FIG. 8 of the drawings, in order to assemble the reinforcing body 32, the reinforcing body 32 may comprise a base member 326 and a top covering member 327 attached on the base member 326 for forming an integral structure of the reinforcing body 32. Each of the base member 326 and the top covering member 327 may have a plurality of connecting holes 329, wherein the top covering member 327 may be attached on the base member 326 through a plurality of connectors 328 which may penetrate the connecting holes 329. The connector 328 may be embodied as screws, bolt and bolt nuts, or other suitable mechanical connectors. Any other means of mechanically connecting the top covering member 327 to the base member 326 may also be utilized.

The base member 326 may further have a plurality of retention edges 3261 inwardly extended from the first sidewall 324 and the second sidewall 325 respectively for retaining the position of the top covering member 327. Specifically, the retention edges 3261 are positioned above the top covering member 327 when it is connected to the base member 326. Thus, the top covering member 327 may have two side engagement edges 3271 adapted for engaging with the retention edges 3261 of the base member 326 when the top covering member 327 is connected to the base member 326. A thickness of the side engagement edges 3271 may be slightly less than a thickness of other parts of the top covering member 327 so as to facilitate effective engagement between the engagement edges 3271 and the retention edges 3261.

The first reinforcing groove 322 may be formed as a space surrounded by an inner surface of the first sidewall 324 and the corresponding retention edge 3261, while the second reinforcing groove 323 may be formed as a space surrounded by an inner surface of the second sidewall 325 and another corresponding retention edge 3261.

The top covering member 327 may further have two blocking flanges 3272 outwardly extended from the two engagement edges 3271 for filling the gap formed between the head connecting member 31 and the two retention edges 3261 of the base member 326. Moreover, the blocking flanges 3272 may also bias against a corresponding top portion 3262 of the retention edge 3261 so that when the reinforcing connector 30 is subject to external pulling force, the top covering member 327 may be securely engaged with the base member 326.

The top covering member 327 may further comprises a plurality of frictional members 3273 spacedly formed on an inner surface 3274 thereon for normally biasing against the corner portion 12 of the screen fabric 10. Each of the frictional members 3273 may have an elongated shape and may be slightly protruded from the inner surface 3274 of the top covering member 327. The frictional members 3273 may be arranged to bias against the corner portion 12 of the screen fabric 10 so as to retain the corner portion 12 in the receiving cavity 321, even if the screen fabric 10 is subject to external pulling force.

The operation of the present invention is as follows: the reinforcing connector 30 may be provided on one corner portion 12 of the screen fabric 10. The corner portion 12 of the screen fabric 10 may be inserted into the receiving cavity 321 of the reinforcing body 32. The corner portion 12 may be secured in the receiving cavity 321 by the connectors 328 penetrating the connecting holes 329. At the same time, a corresponding tightening portion 22 of the tightening wire 20 may be arranged to pass through the first reinforcing groove 322 and the second reinforcing groove 323. When the tightening wire 20 has been tightened, the tightening portion 22 may be accommodated in the first reinforcing groove 322 and the second reinforcing groove 323 and the peripheral securing slot 312 of the head connecting member 31.

One skilled in the art would appreciate that when the tightening portion 22 of the tightening wire 20 is secured in the reinforcing connector 30, the tightening portion 22 is securely reinforced and supported by the reinforcing body 32 and the head connecting body 31. Moreover, the screen fabric 10 does not need to have any reinforcing fabric piece as required in conventional screen fabric. The corner portion 12 of the screen fabric 10 may be secured in the reinforcing body 32.

In view of the above, the problems discussed in relation to conventional shade screen may be substantially prevented. First, the reinforcing fabric piece may not be necessary because the entire corner portion 12 of the screen fabric may be secured in the reinforcing body 32. Second, the tightening portion 22 of the tightening wire 20 may be protected in the first reinforcing groove 322 and the second reinforcing groove 323. In other words, the portion of the tightening wire 20 which is subject to the maximum amount of tension is now prevented from directly contacting with the screen fabric so as to prevent the screen fabric from breakage, as in the case of conventional shade screen discussed above.

The present invention, while illustrated and described in terms of a preferred embodiment and several alternatives, is not limited to the particular description contained in this specification. Additional alternative or equivalent components could also be used to practice the present invention.

What is claimed is:

1. A reinforcing connector for a shade screen having a screen fabric having a corner portion and a tightening wire having a tightening portion, said reinforcing connector, comprising:

a head connecting member having a through connecting slot and a peripheral securing slot formed along a peripheral edge portion of said head connecting member; and a reinforcing body having a tapered cross-sectional shape and extending from said head connecting member, said reinforcing body further having a receiving cavity, a first reinforcing groove and a second reinforcing groove formed on two sides of said receiving cavity and inclinedly extending and indently formed along an inner surface of a first sidewall and an inner surface of a second sidewall of said reinforcing body respectively, said first reinforcing groove and said second reinforcing groove being aligned with two ends of said peripheral securing slot of said head connecting member, in such a manner that said corner portion of said screen fabric is securely attached in said receiving cavity, while said tightening portion of said tightening wire is arranged to pass through said first reinforcing groove and said second reinforcing groove and is fittedly received in said peripheral securing slot so that said tightening wire is substantially reinforced and supported in said reinforcing connector as to prevent said tightening wire from breaking out of said screen fabric when said screen fabric is subject to external force, a width of said reinforcing body gradually increasing from said head connecting member to said screen fabric, said head connecting member and said reinforcing body being integrally connected with each other to form an integral structure of said reinforcing connector, said head connecting member and said through connecting slot having a substantially circular cross-sectional shape, said reinforcing body comprising a base member and a top covering member securely connected to said base member for forming an integral structure of said reinforcing body, wherein said base member further has a plurality of retention edges inwardly extending from said first sidewall and said second sidewall respectively for retaining a position of said top covering member, said retention edges being positioned above said top covering member when said top covering member is connected to said base member, said first reinforcing groove being formed as a space surrounded by an inner surface of said first sidewall and said corresponding retention edge, while said second reinforcing groove being formed as a space surrounded by an inner surface of said second sidewall and another corresponding retention edge.

2. The reinforcing connector, as recited in claim 1, wherein said top covering member has two side engagement edges adapted for engaging with said retention edges of said base member when said top covering member is connected to said base member.

3. The reinforcing connector, as recited in claim 2, wherein said top covering member further has two blocking flanges outwardly extending from said two engagement edges for filling a gap formed between said head connecting member and said two retention edges of said base member, and for biasing against top portions of said retention edges respectively.

4. The reinforcing connector, as recited in claim 3, wherein said top covering member further comprises a plurality of frictional members protruding from an inner surface of said top covering member for biasing against said corner portion of said screen fabric.

5. A shade screen, comprising:

a screen fabric having a main fabric portion and at least one corner portion;

a tightening wire attached on said screen fabric, said tightening wire having a main portion and a tightening portion extending on said corner portion of said screen fabric; and a reinforcing connector, which comprises:

a head connecting member having a through connecting slot and a peripheral securing slot formed along a peripheral edge portion of said head connecting member; and a reinforcing body having a tapered cross-sectional shape and extending from said head connecting member, said a reinforcing body further having a receiving cavity, a first reinforcing groove and a second reinforcing groove formed on two sides of said receiving cavity and inclinedly extending and indently formed along an inner surface of a first sidewall and an inner surface of a second sidewall of said reinforcing body respectively, said first reinforcing groove and said second reinforcing groove being aligned with two ends of said peripheral securing slot of said head connecting member, in such a manner that said corner portion of said screen fabric is securely attached in said receiving cavity, while said tightening portion of said tightening wire is arranged to pass through said first reinforcing groove and said second reinforcing groove and is fittedly received in said peripheral securing slot so that said tightening wire is substantially reinforced and supported in said reinforcing connector as to prevent said tightening wire from breaking out of said screen fabric when said screen fabric is subject to external force, a width of said reinforcing body gradually increasing from said head connecting member to said screen fabric, said head connecting member and said reinforcing body being integrally connected with each other to form an integral structure of said reinforcing connector, said head connecting member and said through connecting slot having a substantially circular cross-sectional shape;

said reinforcing body comprising a base member and a top covering member securely connected to said base member for forming an integral structure of said reinforcing body, wherein said base member further has a plurality of retention edges inwardly extending from said first sidewall and said second sidewall respectively for retaining a position of said top covering member, said retention edges being positioned above said top covering member when said top covering member is connected to said base member, said first reinforcing groove being formed as a space surrounded by an inner surface of said first sidewall and said corresponding retention edge, while said second reinforcing groove being formed as a space surrounded by an inner surface of said second sidewall and another corresponding retention edge.

6. The shade screen, as recited in claim 5, wherein said top covering member has two side engagement edges adapted for engaging with said retention edges of said base member when said top covering member is connected to said base member.

7. The shade screen, as recited in claim 6, wherein said top covering member further has two blocking flanges outwardly extending from said two engagement edges for filling a gap formed between said head connecting member and said two retention edges of said base member, and for biasing against top portions of said retention edges respectively.

8. The shade screen, as recited in claim 7, wherein said top covering member further comprises a plurality of frictional members protruding from an inner surface of said top covering member for biasing against said corner portion of said screen fabric.

9. The shade screen, as recited in claim 6, wherein said screen fabric further has a plurality of receiving pockets peripherally extending along peripheral edges of said main fabric portion wherein said main portion of said tightening wire is received in said receiving pockets.

* * * * *